US008006868B2

(12) United States Patent
Geiberger et al.

(10) Patent No.: US 8,006,868 B2
(45) Date of Patent: Aug. 30, 2011

(54) DISPENSER CAP FOR PRESSURISED FLUIDS

(75) Inventors: Christoph Geiberger, Königswinter (DE); Hans Kraemer, Buehl (DE)

(73) Assignee: GlaxoSmithKline Consumer Healthcare GmbH & Co KG, Buehl (Baden) (DE)

( * ) Notice: Subject to any disclaimer, the term of this patent is extended or adjusted under 35 U.S.C. 154(b) by 911 days.

(21) Appl. No.: 11/874,368

(22) Filed: Oct. 18, 2007

(65) Prior Publication Data

US 2008/0093380 A1 Apr. 24, 2008

(30) Foreign Application Priority Data

Oct. 20, 2006 (GB) ..... 0620943.1
Dec. 11, 2006 (GB) ..... 0624674.8

(51) Int. Cl.
*B67D 1/16* (2006.01)

(52) U.S. Cl. ..... 222/108; 222/148; 222/402.13; 222/571

(58) Field of Classification Search ..... 222/108, 222/148, 402.13, 571, 402.12; 239/119
See application file for complete search history.

(56) References Cited

U.S. PATENT DOCUMENTS

| | | | | |
|---|---|---|---|---|
| 2,894,660 | A | 7/1959 | Gordon | |
| 3,377,005 | A * | 4/1968 | Marder | 222/402.13 |
| 4,978,035 | A * | 12/1990 | Morane et al. | 222/108 |
| 5,732,855 | A | 3/1998 | van der Heijden | |
| 5,785,208 | A * | 7/1998 | Dobbs et al. | 222/148 |
| 6,264,067 | B1 | 7/2001 | Lasserre | |
| 7,104,424 | B2 * | 9/2006 | Kolanus | 222/153.11 |

FOREIGN PATENT DOCUMENTS

| | | |
|---|---|---|
| WO | WO 01/62212 | 8/2001 |
| WO | WO 2006/013353 | 2/2006 |

* cited by examiner

*Primary Examiner* — Kevin P Shaver
*Assistant Examiner* — Daniel R Shearer
(74) *Attorney, Agent, or Firm* — Joshua C. Sanders; Theodore R. Furman

(57) ABSTRACT

A valve actuator for a valved container containing a pressurized fluid, the actuator comprising a mounting to attach the actuator to the container, and characterized by a post-expansion chamber in communication with the outlet of the actuator in which residual fluid remaining in the outlet after use can expand, and a separate suction chamber in communication with the outlet conduit via a suction opening to suck residual fluid back toward the expansion chamber.

16 Claims, 8 Drawing Sheets

10
20
213
24

10
20
24
213

20
11
12
14
13
21
22
23
212
29
211
26
28
24
25
210
213
27
10

20
24
213
10

DISPENSER CAP FOR PRESSURISED FLUIDS

FIELD OF THE INVENTION

The present invention relates to actuator devices for containers of pressurised fluids having a valve stem which is operably moveable by means of the actuator device.

BACKGROUND OF THE INVENTION

It is well known to provide pressurised fluids such as aerosols, foams etc. in pressurised containers having a valve which is operated, typically depressed in the longitudinal direction of a cylindrical container, by means of an actuator moveably mounted on the container. A typical form of such a container is a cylindrical can with a valve stem extending in the direction of the cylindrical axis. Such a valve is typically reciprocally resiliently operable so that it is depressed by pressure against its resilience to open the valve, and on release of the pressure returns under its resilience to close the valve. One type of such a container is the so called bag-in-can container in which a fluid, typically a viscous gel, is contained within a flexible bag within the container, and a compressed propellant is provided in the space between the container wall and the bag to compress the bag and thereby squeeze the fluid out of the bag, the valve being in communication with the bag. Often such fluids are expandable and include an expansion agent which vapourises when the fluid is exposed to ambient atmospheric pressure after expulsion from the bag to thereby expand the fluid. An example of such a fluid suitable for use in a bag in can container, being a dentifrice, is disclosed in WO-A-01/62212. Typically the expansion agent is isopentane.

A problem with such expandable fluids is that of post-expansion of residual fluid remaining in the outlet conduit of the container immediately upstream of the outlet opening after use. The continued expansion of the fluid can cause the residual fluid to drool out of the outlet opening and cause an unpleasant mess.

A known solution to this problem is the provision of a post-expansion chamber in the actuator upstream of the outlet opening into which residual fluid can expand. It is known to make such post expansion chambers expandable so that residual fluid can be sucked into the post expansion chamber after operation of the actuator. Examples of actuator devices incorporating such a post expansion chamber are for example disclosed in WO-A-2006/013353, U.S. Pat. No. 2,894,660, U.S. Pat. No. 5,732,855 and U.S. Pat. No. 6,264,067. A problem of actuator devices of this state of the art is that residual fluid sucked into the post expansion chamber in this way builds up in volume in the post expansion chamber because it cannot easily evaporate so that the effectiveness of the device gradually declines with time.

It is an objective of the present invention to address this problem and to provide a solution. Other objectives and advantages of the present invention will be apparent from the following description.

SUMMARY OF THE INVENTION

According to the present invention a valve actuator is provided for a container containing a pressurised fluid and having an operable valve via which the fluid is dispensed, the actuator comprising:

a mounting attachable to the container, a control part moveably mounted on the mounting, the control part incorporating a valve operator operably connectable to the valve when the mounting is attached to the container, and incorporating an outlet conduit via which fluid may flow from the valve to an outlet opening, the control part being moveable in a first direction to operate the valve to release fluid from the container, and being moveable in a second direction after use to thereby operate the valve to cease the flow of fluid; characterized by:

a variable volume post-expansion chamber provided in communication with the outlet conduit via an expansion opening and in which residual fluid remaining in the outlet conduit after use can expand, and a variable volume suction chamber in communication with the outlet conduit via a suction opening which is more constricted relative to the flow of the fluid than is the expansion opening, the volume of the variable volume post expansion chamber and the suction chamber being reduced on movement of the control part in the first direction and increased on movement of the control part in the second direction.

DETAILED DESCRIPTION OF THE INVENTION

The actuator of the invention is believed to address the above-mentioned problem of state of the art actuator devices in the following way. The suction chamber and post expansion chamber are separated so that there is less tendency for fluid to enter the suction chamber and to collect therein. Because the suction opening is more constricted than the expansion opening the suction chamber can apply negative pressure to the outlet conduit via the suction opening to suck residual fluid back from the outlet opening, but as the sucked-back residual fluid expands it tends to follow the path of least resistance and expand in the post expansion chamber in preference to passing through the suction opening. When the actuator is next operated by moving the control part in the second direction this will create positive air pressure which will tend to force any accumulated residual fluid out of the suction opening toward the outlet conduit.

The expansion opening and the suction opening are positioned upstream from the outlet opening of the conduit. By such positioning the suction chamber can act to suck residual fluid back from the outlet opening.

The expansion opening and the suction opening may be adjacent to each other. This may have the advantage that when residual fluid is sucked back in the outlet conduit this fluid is sucked into a position adjacent to the expansion opening, thereby reducing any tendency for fluid to be sucked into the suction opening. Also the fluid may thereby be sucked into a position which facilitates expansion into the post expansion chamber.

The post-expansion chamber is a variable volume expansion chamber, the volume of the expansion chamber being reduced on movement of the control part in the first direction and increased on movement of the control part in the second direction. The post-expansion chamber provides a volume into which the residual fluid in the outlet conduit can expand.

The suction chamber is a variable volume chamber within which the increase in volume tends to create an air pressure which is less than atmospheric, and this reduced pressure is communicated via the suction opening to the outlet conduit to thereby suck residual fluid in the outlet conduit back from the outlet opening.

The post-expansion chamber and suction chamber may conveniently be provided by a construction of the control part in two parts which define these chambers as variable volume cavities between them, and in which the two parts are relatively moveable together to vary the volume of the cavities.

On moving the two parts closer together the volume of such cavities is decreased; on moving the two parts further apart the volume of the cavities is increased.

One of such two parts may comprise a resiliently flexible wall, and the other may comprise a base part, relative to which the resiliently flexible wall can move, e.g. reciprocally to vary the volume between them. For example such a resiliently flexible wall may be made of a resiliently flexible plastics material such as low density polyethylene (LDPE), and may for example have a bellows structure, e.g. being undulating in section or having alternating relatively thick and thin wall regions. Alternatively such a resiliently flexible wall may be made of an elastic material, e.g. an elastomer material.

Such a base part may be made of a plastics material such as polypropylene. The two parts of such a control part may for example be conveniently connected together by a snap-fit connection. Other forms of connection are of course feasible.

For example a resiliently flexible wall part may comprise a skirt that snap-fits into a mating groove on the base part, or if made of an elastomer material may friction- or compression-fit into such a groove.

For example such a variable volume expansion chamber may be provided by means of a relatively moveable piston and cylinder. Such a piston and cylinder may telescope together in a generally known manner upon movement of the control part. For example such a piston may fit within the cylinder. Such a piston may be a hollow piston having an internal cavity such that the interior of the hollow piston comprises the expansion chamber or a part thereof.

For example the variable volume suction chamber may be defined by means of a chamber defined between the flexible wall and the base part, the volume of which can be reduced by external pressure applied to the wall by an operator to move it, and which returns back resiliently on release of external pressure toward its original volume to thereby cause negative atmospheric pressure in the suction chamber.

For example such a chamber may be defined by the above-mentioned resiliently flexible wall made of an elastic material such as a thermoplastic elastomer. Thermoplastic elastomers are known elastic materials which are easily formed into shaped parts by injection moulding.

For example such a chamber may be defined by the above-mentioned resiliently flexible wall provided by a bellows construction, for example made of a resilient plastics material.

Such a resiliently flexible wall defining the suction chamber may be in the form of an operating button operably connected to the control part, so that in use the user may exert pressure upon such an operating button to move the resiliently flexible wall to thereby reduce the volume of the suction chamber, and also to move the control part in the first direction. The movement of the resiliently flexible wall to reduce the volume of the suction chamber may occur before, simultaneously or subsequently to the movement of the control part in the first direction.

In a preferred embodiment the above-mentioned piston may be made integrally with such a resiliently flexible wall defining the suction chamber.

The volume of the post-expansion chamber and the suction chamber may be reduced on movement of the control part in the first direction and increased on movement of the control part in the second direction by various constructions.

For example a variable volume suction chamber may be provided by means of a chamber defined by a resiliently flexible wall as described above, and the variable volume post-expansion chamber may be provided by means of a relatively moveable piston and cylinder as described above, and the resiliently flexible wall defining the suction chamber may be connected to one of the piston or the cylinder, for example to the piston. For example one of the piston or the cylinder, for example the piston, may be made integrally with the resiliently flexible wall of the suction chamber.

The variable volume post-expansion chamber is in communication with the outlet conduit via an expansion opening. Such an expansion opening may be relatively wide. For example the expansion opening may have a cross sectional area of 50% or more of the widest cross sectional area of the post-expansion chamber. For example the post expansion chamber may be cylindrical and the expansion opening may have a cross sectional area of 50% or more of the widest cross sectional area of such a cylindrical post-expansion chamber. For example the expansion opening may have a cross sectional area comparable with e.g. at least 75% of, equal to or greater than, the cross sectional area of the outlet conduit at the point where the expansion opening communicates with the outlet conduit.

The variable volume suction chamber is in communication with the outlet conduit via a suction opening which is more constricted relative to the flow of the fluid than is the expansion opening. Such a suction opening may have a greatest dimension across the direction of flow through the suction opening which is less than the smallest dimension across the direction of flow through the expansion opening. In an embodiment the suction opening may be partly, preferably completely, closed as a result of the control part moving in the first direction to reduce the volume of the suction chamber. This closing of the suction opening may be achieved by providing a closure means which operates to close the suction opening, e.g. being operably connected to the wall of the suction chamber, when the volume of the suction chamber is reduced by external pressure applied by an operator. Such a closure means may operate to open the suction opening when the suction chamber returns back resiliently toward its original volume.

In a preferred embodiment, the variable volume post-expansion chamber is provided by means of a relatively moveable piston and cylinder as described above, and the suction opening is provided as a gap between the piston and cylinder. Such a gap may for example circumferentially surround the piston, or may for example be provided by a channel in one or both of the facing surfaces of the piston or cylinder. To provide an embodiment in which the suction opening is closed when the control part moves in the first direction such a piston and cylinder may have a mating conical profile so that when the volume of the post-expansion chamber is at its least, the conical piston mates against the interior surface of the cylinder to at least partly, preferably completely, close the gap between the piston and the cylinder. Conversely when the volume of the post-expansion chamber is at its greatest, the surfaces of such a conical piston and the interior surface of the cylinder are separated to provide the gap between the piston and the cylinder.

A conical piston made of a resilient material, e.g. made integrally with the resiliently flexible wall of the suction chamber as described above, may have the further benefit that if it is a hollow piston, in that as the piston mates with the cylinder on moving in the first direction the interior surface of the cylinder may bear upon the outer surface of the piston to collapse the internal cavity of the hollow piston, to thereby further reduce the volume of the post-expansion chamber.

The first and second directions are preferably reciprocal relative to each other.

The mounting may be generally conventional, e.g. a skirt with engagement means adjacent its lower rim to engage with a conventional bead on the container. The control part may be moveably mounted on the mounting in a known manner by means of an integral construction with the mounting with resilient hinge parts between the control part and the mounting.

Various types of valve operators are well known and are conventional. One type of operator comprises a valve seat which mates with the valve, and which is moved by the movement of the control part. Such a valve seat is typically in the form of a cup which fits over the end of the valve and includes an upstream end of the outlet conduit.

The actuator may be made of conventional materials such as plastics material typically polypropylene, and resiliently flexible parts may be made of elastomer materials such as thermoplastic elastomer, or of a resiliently flexible plastics material such as low density polyethylene.

Therefore in a particularly preferred form of the valve actuator device of this invention:

the post-expansion chamber and the suction chamber are provided by a two-part construction of the control part, one of the two parts comprising a resiliently flexible wall, and the other comprising a base part, the variable volume suction chamber is provided by a chamber defined as a cavity between the resiliently flexible wall and the base part, the volume of which cavity can be reduced by external pressure applied by an operator to move the wall toward the base part, and which on release of the external pressure returns back resiliently toward its original volume to thereby cause negative atmospheric pressure in the suction chamber, the resiliently flexible wall of the suction chamber is in the form of an operating button operably connected to the control part, so that in use the user may exert external pressure upon the resiliently flexible wall to thereby reduce the volume of the suction chamber, and to move the control part in the first direction, the variable volume post-expansion chamber comprises a relatively moveable piston and cylinder, the piston being integral with the flexible wall, the piston and cylinder having a mating conical profile so that when the volume of the post-expansion chamber is at its least the conical piston mates against the interior surface of the cylinder to at least partly close a gap between the piston and the cylinder, and when the volume of the post-expansion chamber is at its greatest the surfaces of the conical piston and the interior surface of the cylinder are separated to provide a gap between the piston and the cylinder, the gap comprising the suction opening.

Preferred details of such an actuator are as herein.

The valve actuator of the present invention may be mounted upon a container containing a pressurised fluid and having an operable valve via which the fluid is dispensed, to provide a dispenser for the fluid. Such a container and fluid may be generally conventional. For example such a container may be the so called bag-in-can container in which a fluid, typically a viscous gel, is contained within a flexible bag within the container, and a compressed propellant is provided in the space between the container wall and the bag to compress the bag and thereby squeeze the fluid out of the bag, the valve being in communication with the bag. Such a dispenser comprising a valve actuator of the invention mounted on such a container comprises another aspect of this invention.

BRIEF DESCRIPTION OF THE DRAWINGS

The invention will now be described by way of example only with reference to the following drawings.

Parts shown in FIGS. 1-11 are listed below.

Figures 1, 2, 3, 4:
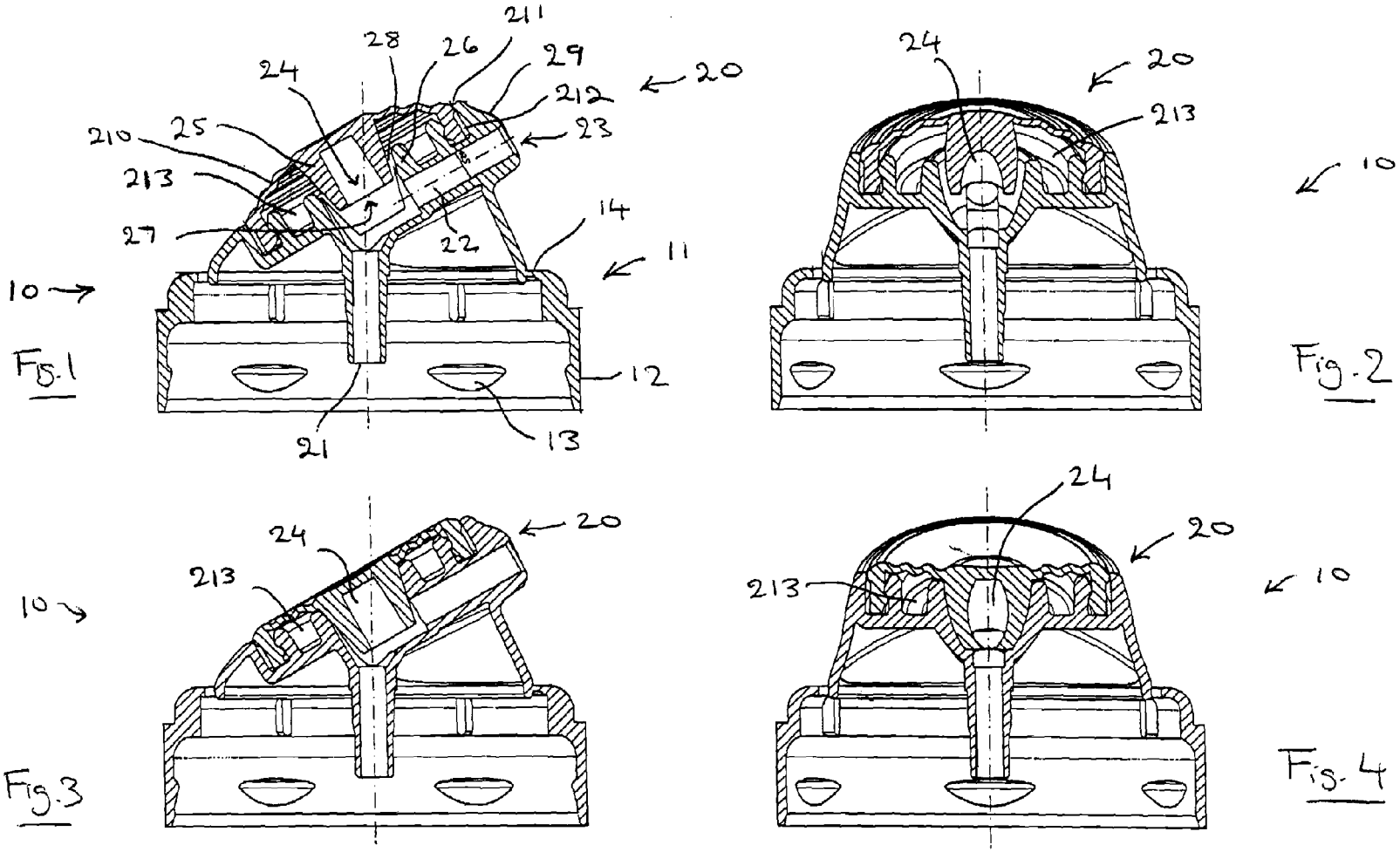
FIG. 1 shows a vertical sectional view through an actuator device of the invention in a first configuration.
FIG. 2 shows a vertical sectional view through an actuator device of the invention cut along a vertical plane perpendicular to the plane of the cut of FIG. 1.
FIG. 3 shows a vertical sectional view through an actuator device of the invention in the same plane as FIG. 1 in a second configuration.
FIG. 4 shows a vertical sectional view through an actuator device of the invention cut along a vertical plane perpendicular to the plane of the cut of FIG. 3.

10, 50, 60, 70, 80, 90, 100, 110 actuator device overall
11 mounting
12 skirt
13 snap-fit beads
14 hinge
20 control part
21 valve operator
22 outlet conduit
23 outlet opening
24 post-expansion chamber
25 moveable piston
26 cylinder
27 expansion opening
28 gap
29 base part
210 part being a resiliently flexible wall
211 peripheral skirt
212 mating groove
212 variable volume suction chamber
51 interlocking pin and socket connector
71 resilient elements
72 support ring
81 pressure part
82 downwardly projecting part
91 vents
101 piston
102 cylinder
111 conical piston
112 resiliently flexible wall
113 connection Referring to FIGS. 1 and 2, an actuator device is shown overall 10.

The actuator 10 comprises a mounting 11 in the form of a skirt 12 which is attachable to a conventional container (not shown) by means of snap-fit beads 13 around the interior of the skirt 12 which engage with a co-operating bead on the container. This arrangement is entirely conventional. The mounting is made of a plastics material, polypropylene.

A control part 20 is moveably mounted on the mounting 11. The control part 20 is moveably hinged to the mounting 11 by integral film hinge 14 which allows the control part 20 to pivot anti-clockwise as seen in FIG. 1. Prior to use the control part 20 may be connected to mounting 11 by thin integral links (not shown) which shear on first use in a conventional manner.

The control part 20 incorporates a valve operator 21 in the form of a tubular valve seat which connects to the valve, e.g. a valve stem (not shown), of a container (not shown), in the conventional manner of actuators of pressurised containers. Various other conventional constructions of valve operator will be apparent to those skilled in the art appropriate to the various forms of valve known in the art.

In a conventional manner, with the mounting 11 mounted on a container with its valve seat 21 mated with the valve stem of the container, when downward pressure is applied by the user to the control part 20, the part 20 pivots anticlockwise about hinge 14, i.e. moving in a first direction, so that the valve seat 21 thereby bears downwardly upon the valve stem (not shown) to depress it to thereby actuate it to release fluid from the container. Conventionally the valve stem (not shown) is resilient so that when the user releases the downward pressure the valve stem moves upward to close, and moves the control part 20 reciprocally to pivot about hinge 14 clockwise, i.e. in a second direction, after use.

The control part 20 incorporates an outlet conduit 22 communicating with the valve seat 21 via which fluid (not shown) may flow from the valve stem to an outlet opening 23. The above described is the entirely conventional construction and operation of an actuator.

A post-expansion chamber 24 is provided by a relatively moveable piston 25 and cylinder 26 which telescope together. The piston 25 is externally conical, and is a hollow piston having an internal cavity which together with the interior of cylinder 26 comprises a part of the expansion chamber 24. The cylinder 26 is also conical. In FIGS. 1 and 2 the piston 25 and cylinder 26 are relatively apart so that the total volume of the expansion chamber 24 and outlet conduit 22 is larger, and in FIGS. 3 and 4 the piston 25 and cylinder 26 are relatively closer together so that this total volume is smaller. The expansion chamber 24, i.e. the internal cavity of piston 25, is in communication with the outlet conduit 22 via an expansion opening 27. As seen in FIG. 1 there is a gap 28 between the piston 25 and cylinder 26. As seen in FIG. 3 the piston 25 is fully inserted into the cylinder 26, and the gap 28 is closed.

The control part 20 is of two-part construction, comprising a base part 29 integrally made of polypropylene with the mounting 11, and a part 210 being a resiliently flexible wall made of low density polyethylene. The part 210 is of bellows construction, being generally circular in shape and having an undulating section when cut radially. The part 210 has a peripheral skirt 211 which snap-fits into a corresponding mating groove 212 in the base part 29 in an airtight seal.

Between the base part 29 and the resiliently flexible wall 210 is a cavity being a variable volume suction chamber 213. The resiliently flexible wall 210 defining the suction chamber 213 is in the form of a convex domed operating button. The piston 25 is made integrally with wall 210, extending inwardly therefrom.

In use the user may exert pressure upon the wall 210, and the dome shape of the wall 210 collapses as seen in FIG. 3 so that this pressure is applied to the control part 20 to thereby move the control part 20 in the first direction, i.e. pivoting anti-clockwise about hinge 14 to actuate the valve stem (not shown). This causes fluid (not shown) to flow along the valve seat 21, along conduit 22, and out through outlet opening 23.

This application of external pressure to wall 210 also reduces the volume of the suction chamber 213, as seen in FIG. 3. The collapse of the chamber 213 as the wall 210 moves brings the piston 25 and cylinder 26 together as also seen in FIG. 3, so that the gap 28 is closed. Moreover, the lower part of the cylinder 26 is internally smaller than the external size of the piston 25, so the piston 25 is compressed as it descends into the cylinder as seen in FIG. 3.

When this pressure on the wall 210 is released, because the wall 210 is resilient it springs back into the position shown in FIGS. 1 and 2, toward its original volume. This expansion causes negative atmospheric pressure in the suction chamber 213. This resilient movement of the wall 210 also withdraws the piston 25 from its position within cylinder 26, and opens the gap 28 between the piston and cylinder. The gap 28 functions as a suction opening by which the suction chamber 213 is in communication with the outlet conduit 22. Simultaneously the release of user pressure on the wall 210 causes the valve stem (not shown) to close and the flow of fluid along conduit 22 to cease, but leaving residual fluid (not shown) in the conduit 22. The negative atmospheric pressure within suction chamber 213 is communicated to outlet conduit 22 via gap 28 which is opened as the piston 25 moves upward. This negative atmospheric pressure sucks this residual fluid (not shown) in conduit 22 back from the outlet opening 23. Additional suction is provided by the increase in volume of the post expansion chamber 24 as the piston 25 is withdrawn from cylinder 26.

The gap 28 is more constricted relative to the flow of the fluid than is the expansion opening 27. Consequently there is more tendency for sucked-back fluid to flow into the expansion opening 27 than through the gap 28. It is also seen that the gap 28 is adjacent to the expansion opening 27. This tends to cause the fluid (not shown) to expand into the expansion chamber 24 rather than through gap 28.

Thereafter, residual fluid (not shown) in the conduit 22 expands into the post expansion chamber 24 rather than oozing out through the opening 23. This residual fluid in the post expansion chamber 24 can gradually evaporate through outlet opening 23 so that conduit 22 and chamber 24 are empty ready for the next use of the device.

Figure 5:
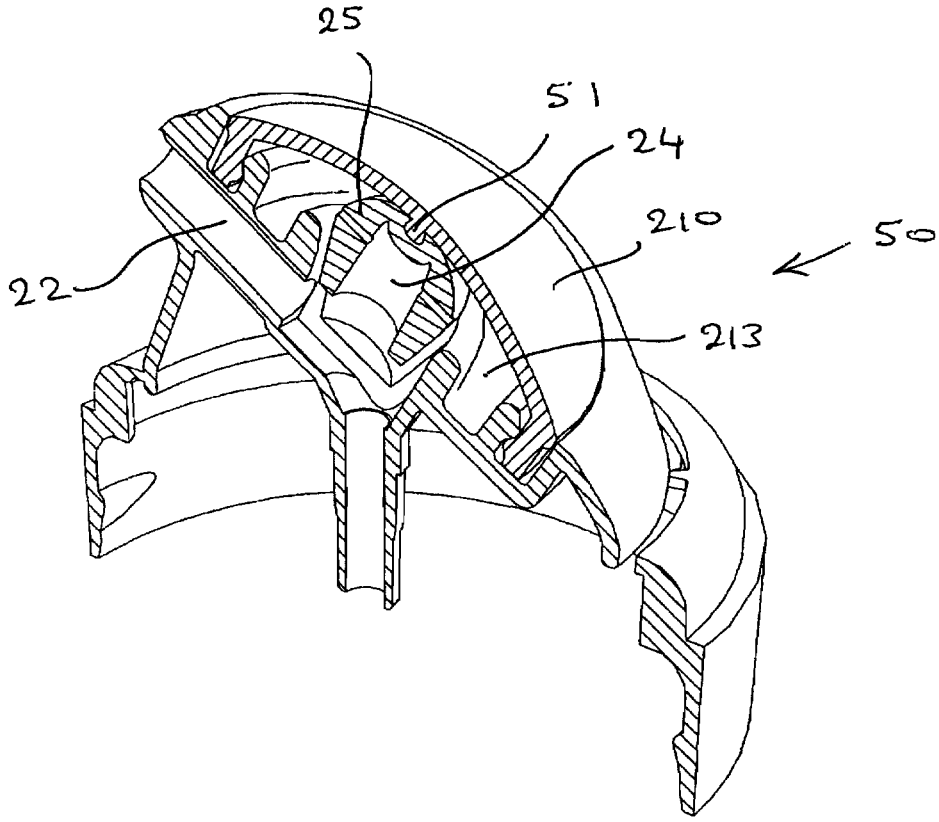
FIGS. 5-11 show perspective views of other actuator devices of this invention, cut along a vertical plane.
Figure 6:
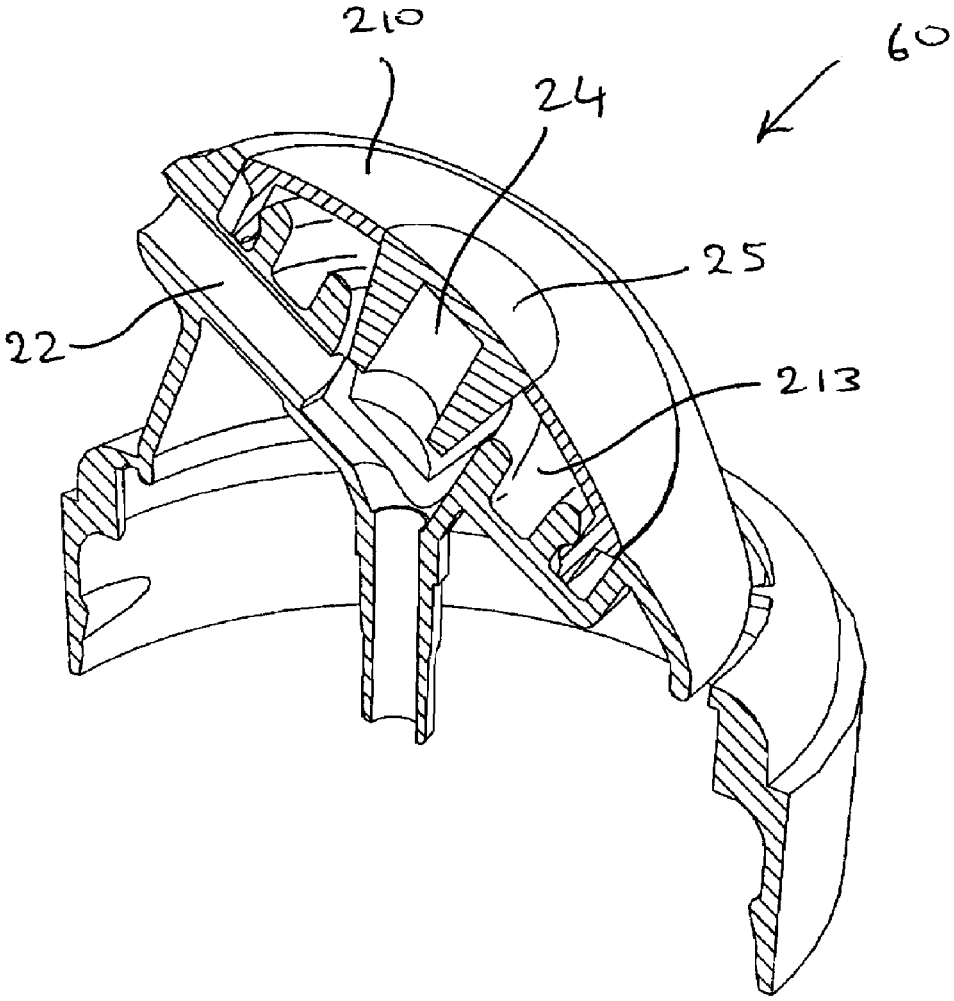

Referring to FIGS. 5 and 6, features in common with FIGS. 1-4 are numbered correspondingly, and only differences from FIGS. 1-4 are described in detail. The actuator devices 50 and 60 of FIGS. 5 and 6 respectively have a dome shaped resiliently flexible wall 210 as in FIGS. 1-4, and a conical piston 25. But in contrast to FIGS. 1-4 the conical piston 25 is not made integrally with wall 210 but is made as a separate part which is attached to the wall 210. In FIG. 5 the piston 25 is attached to the wall 210 by the interlocking pin and socket connector 51. In FIG. 6 the piston 25 is attached to wall 210 by the known technique of two-component injection moulding which creates a bond between the piston 25 and the wall 210 around the perimeter of piston 25.

Figure 7:
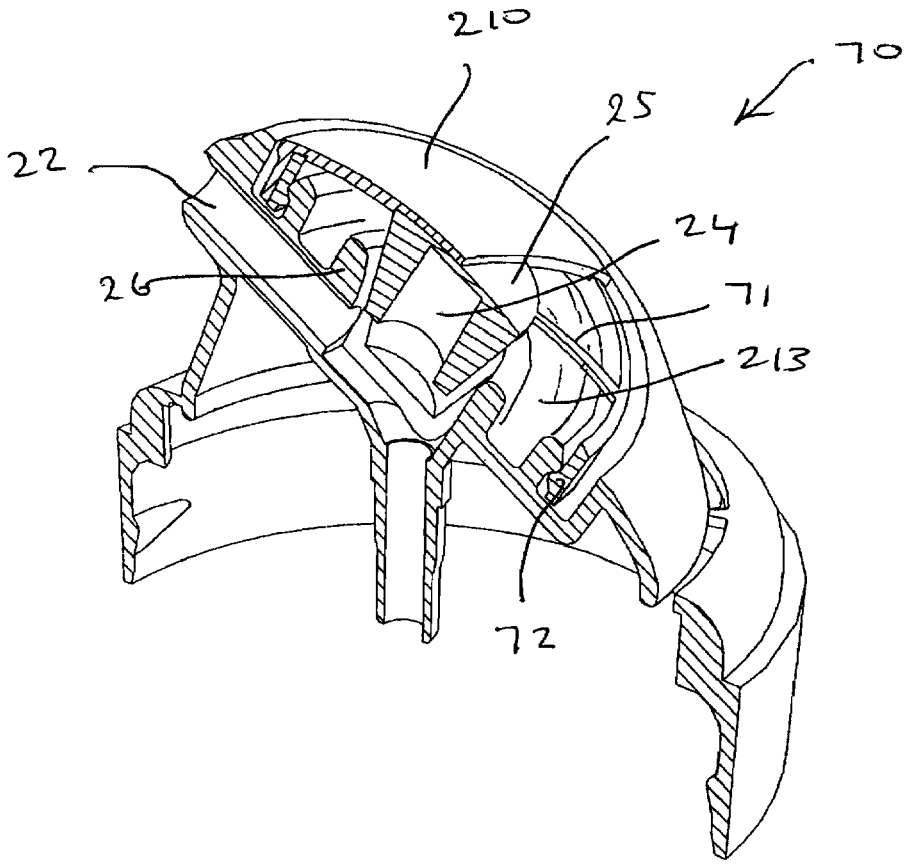

Referring to FIG. 7, features in common with FIGS. 1-4 are numbered correspondingly, and only differences from FIGS. 1-4 are described in detail. The actuator device 70 has a dome shaped wall 210 as in FIGS. 1-4. But in the actuator of FIG. 7 the piston 25 is formed integrally with resilient elements 71 which are themselves integrally formed with a support ring 72 engaged with the control part 20, and the dome shaped wall 210 is formed separately from the piston 25. Consequently the piston 25 is resiliently connected to the control part 20 by the resiliently flexible connections 71. When the dome 210 is depressed by the user, being in contact with the piston 25 this causes the piston 25 to move downwardly, as described above, against the resilience of the elements 71 into the cylinder 26. When the user's pressure on the dome shaped wall 210 is released the wall 210 springs back to its original shape under its own resilience, and the resilient elements 71 cause the piston 25 to return to its original position analogous to FIG. 1.

Figure 8:
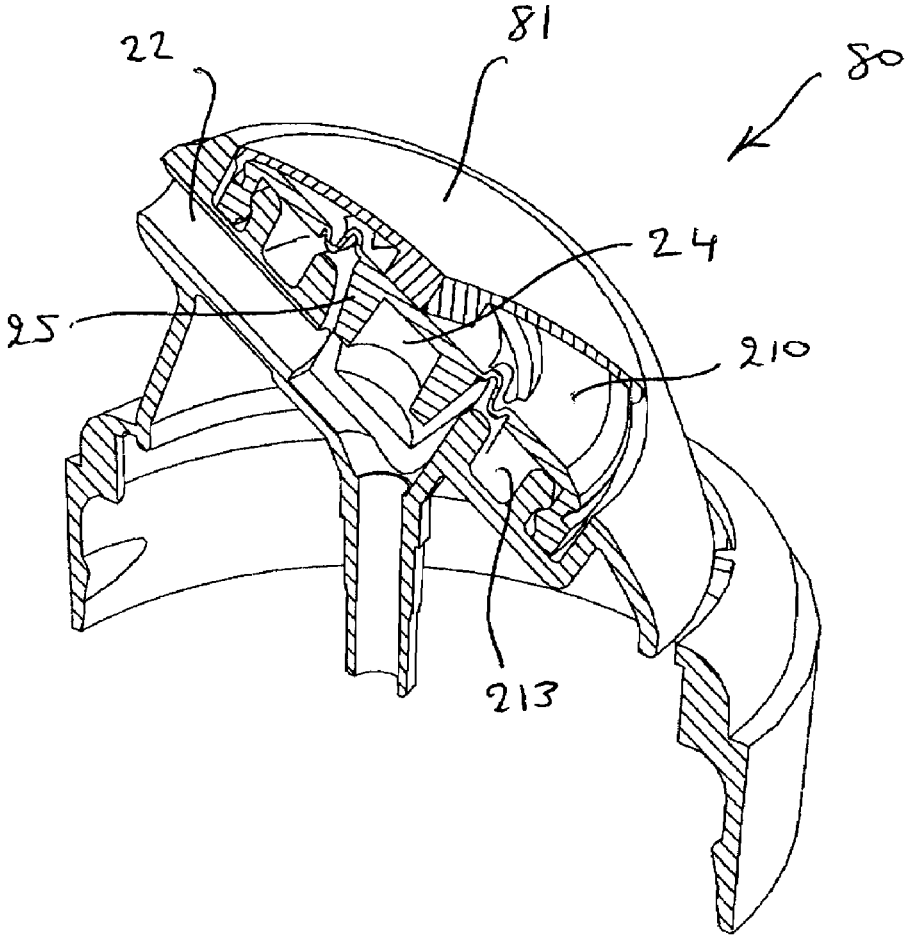

Referring to FIG. 8, features in common with FIGS. 1-4 are numbered correspondingly, and only differences from FIGS. 1-4 are described in detail. The actuator device 80 has a resiliently flexible wall 210 as in FIGS. 1-4, and the piston 25 is formed integrally with the wall 210. In use, instead of the operator applying pressure directly to the wall 210, a pressure part 81 is provided covering the wall 210. The pressure part 81 is itself in the form of a resiliently flexible dome with an integral downwardly projecting part 82. When the cover 81 is depressed by user pressure the part 82 bears upon the wall 210 and urges it downward into the cylinder 26 in a manner analogous to FIGS. 1-4.

Figure 9:
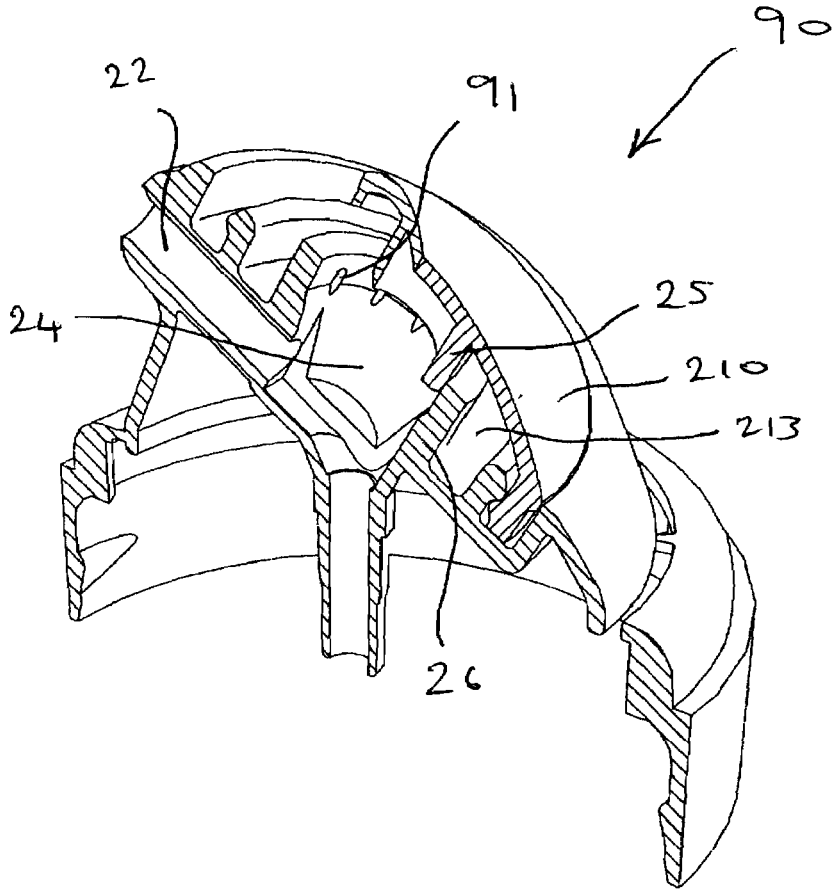

Referring to FIG. 9, features in common with FIGS. 1-4 are numbered correspondingly, and only differences from FIGS. 1-4 are described in detail. The actuator device 90 has a resiliently flexible wall 210 as in FIGS. 1-4, and the piston 25 is formed integrally with the wall 210, identical to FIGS. 1-4. Small vents 91 are provided through the wall of cylinder 26 providing communication between the interior of the cylinder 26 and the suction chamber 29. The piston 25 and cylinder 26 are cylindrical in shape. The vents 91 are so positioned that when the piston 25 is most withdrawn from the cylinder as shown in FIG. 9 the vents 91 are open so that air can be sucked from the expansion chamber 24 into the suction chamber 29, but when the piston 25 is most closely engaged with cylinder 26 the vents 91 are obstructed by piston 25 and thereby closed. The vents 91 are constricted relative to the expansion opening 27. In use the actuator of FIG. 9 is operated analogously to the actuator of FIGS. 1-4.

Figure 10:
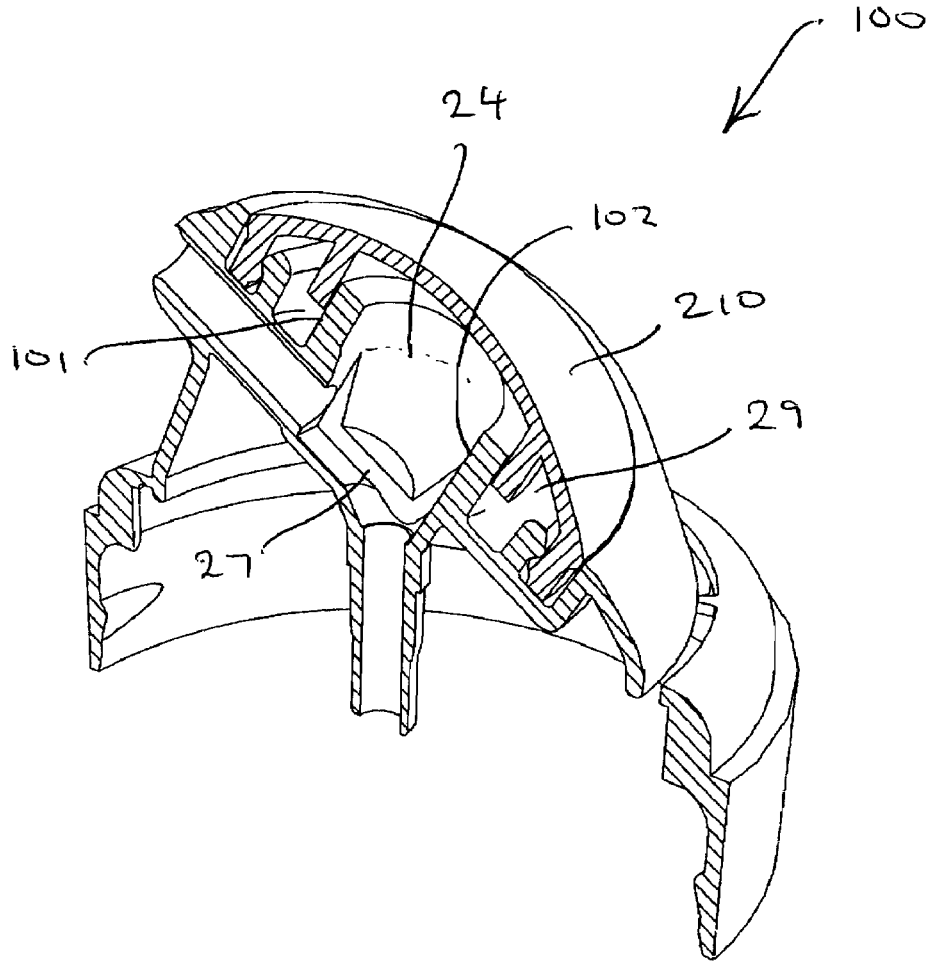

Referring to FIG. 10, features in common with FIGS. 1-4 are numbered correspondingly, and only differences from FIGS. 1-4 are described in detail. The actuator device 100 has a resiliently flexible wall 210 as in FIGS. 1-4, and the piston 25 is formed integrally with the wall 210. In contrast to the piston and cylinder of FIGS. 1-9 the piston 101 externally surrounds cylinder 102 in a smooth sliding fit. In use the actuator of FIG. 10 is operated analogously to the actuator of FIGS. 1-4. As the dome shaped wall 210 is depressed by user pressure as in FIGS. 1-4 the piston 101 slides downwardly around cylinder 102 to reduce the volume of the expansion chamber 24 within the combination of piston 101 and cylinder 102, and simultaneously to reduce the volume of suction chamber 29. Air in suction chamber 29 can escape from suction chamber 29 as the volume is decreased via the gap between piston 101 and cylinder 102. When the user pressure is released the resilient wall 210 springs upward again under its own resilience to increase the volume of expansion chamber 24, and also to increase the volume of suction chamber 29 to create negative atmospheric pressure therein. This negative pressure is communicated to the flow conduit 22 via the gap between piston 101 and cylinder 102 so that residual fluid (not shown) in flow conduit 22 is sucked back toward the expansion chamber 24. This gap between piston 101 and cylinder 102 is narrow and constricted relative to the expansion opening 27.

Figure 11:
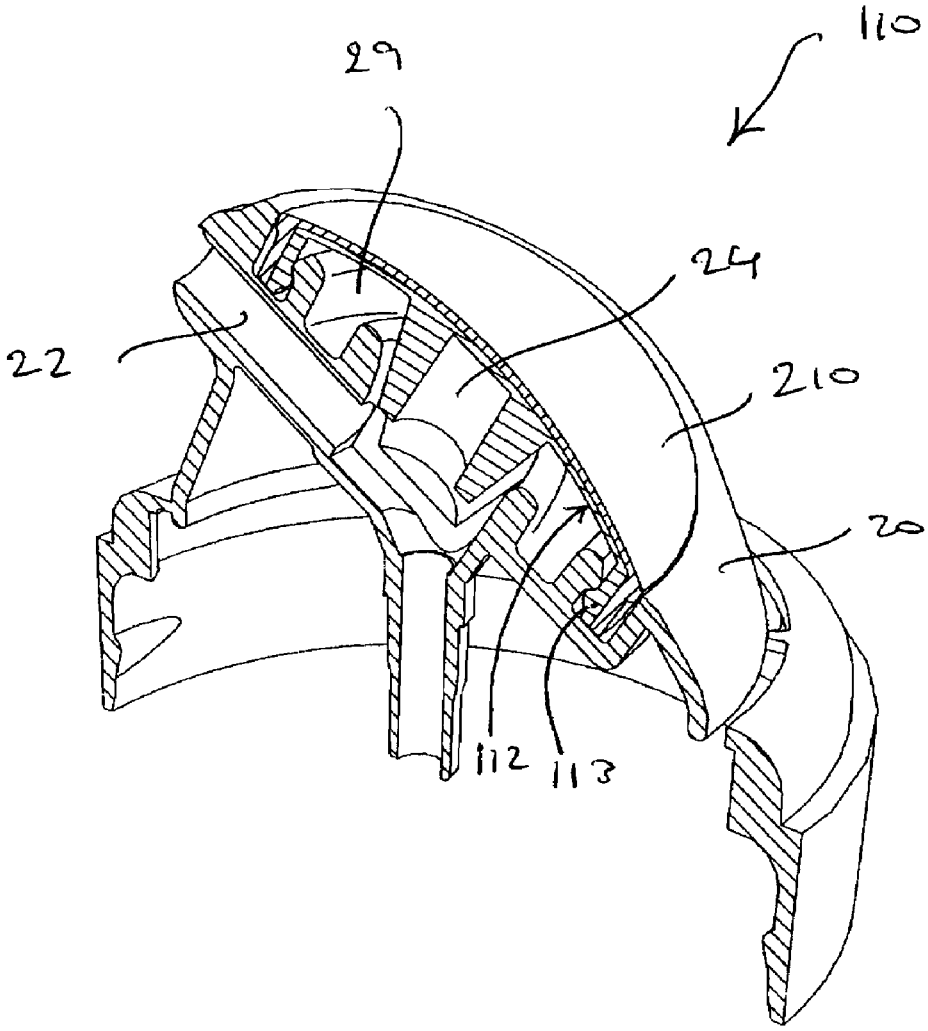

Referring to FIG. 11, features in common with FIGS. 1-4 are numbered correspondingly, and only differences from FIGS. 1-4 are described in detail. The actuator device 110 has a resiliently flexible wall 210 as in FIGS. 1-4. However the conical piston 111 is formed integrally as part of a resiliently flexible wall 112 which is connected to the control part 20 at 113 and which defines the suction chamber 29. The operation of the actuator of FIG. 11 is analogous to that of the actuators of FIGS. 1-10. User pressure on the wall 210 is communicated to wall 112 to thereby cause the suction chamber 29 to reduce in volume as above. Release of user pressure on wall 210 causes the wall 210, and also the wall 112, to resiliently spring back to their original shape, thereby increasing the volume of the suction chamber 29, as above.

What is claimed is:

1. A valve actuator for a container containing a pressurised fluid and having an operable valve via which the fluid is dispensed, the actuator comprising:

a mounting attachable to the container, a control part moveably mounted on the mounting, the control part incorporating a valve operator operably connectable to the valve when the mounting is attached to the container, and incorporating an outlet conduit via which fluid may flow from the valve to an outlet opening, the control part being moveable in a first direction to operate the valve to release fluid from the container, and being moveable in a second direction after use to thereby operate the valve to cease the flow of fluid; comprising:

a variable volume post-expansion chamber provided in communication with the outlet conduit via an expansion opening between the outlet conduit and the post-expansion chamber and in which residual fluid remaining in the outlet conduit after use can expand, a variable volume suction chamber in communication with the outlet conduit via a suction opening between the outlet conduit and the suction chamber and adjacent to the expansion opening, the volume of the variable volume post expansion chamber and the suction chamber being reduced on movement of the control part in the first direction and increased on movement of the control part in the second direction, such that the increase in volume of the suction chamber results in negative pressure within outlet conduit which draws fluid in the outlet conduit back away from the outlet opening, the suction opening being more constricted relative to the flow of the fluid than is the expansion opening such that fluid drawn back from the outlet opening expands into the expansion chamber in preference to passing through the suction opening.

2. An actuator according to claim 1 wherein the control part is in two parts which define the post-expansion and suction chambers as variable volume cavities between the two parts, and in which the two parts are relatively moveable together to vary the volume of the cavities, on moving the two parts closer together the volume of such cavities is decreased; on moving the two parts further apart the volume of the cavities is increased.

3. An actuator according to claim 1 wherein the variable volume expansion chamber is provided by means of a relatively moveable piston and cylinder.

4. An actuator according to claim 3 wherein the piston is a hollow piston having an internal cavity such that the interior of the hollow piston comprises part of the expansion chamber.

5. An actuator according to claim 1 wherein the variable volume suction chamber is provided by means of a resiliently flexible walled chamber the volume of which can be reduced by external pressure applied by an operator, and which returns back resiliently toward its original volume to thereby cause negative atmospheric pressure in the suction chamber.

6. An actuator according to claim 5 wherein the resiliently flexible wall of the suction chamber comprises an operating button operably connected to the control part, so that in use the user may exert pressure upon such an operating button to thereby reduce the volume of the suction chamber, and to simultaneously or subsequently move the control part in the first direction.

7. An actuator according to claim 5 wherein the variable volume post-expansion chamber comprises a relatively moveable piston and cylinder, and the wall of the suction chamber is connected to one of the piston or the cylinder.

8. An actuator according to claim 7 wherein the piston is made integrally with the wall of the suction chamber.

9. An actuator according to claim 1 wherein the expansion opening has a cross sectional area of 50% or more of the widest cross sectional area of the post-expansion chamber.

10. An actuator according to claim 1 wherein the expansion opening has a cross sectional area at least 75% of, equal to or greater than, the cross sectional area of the outlet conduit at the point where the expansion opening communicates with the outlet conduit.

11. An actuator according to claim 1 wherein the suction opening has a greatest dimension across the direction of flow through the suction opening which is less than the smallest dimension across the direction of flow through the expansion opening.

12. An actuator according to claim 1 wherein the suction opening is closed as a result of the control part moving in the first direction to reduce the volume of the suction chamber.

13. An actuator according to claim 7 wherein the suction opening comprises a gap between the piston and cylinder.

14. An actuator according to claim 13 wherein the piston and cylinder have a mating conical profile so that when the volume of the post-expansion chamber is at its least, the conical piston mates against the interior surface of the cylinder to close the gap between the piston and the cylinder, and when the volume of the post-expansion chamber is at its greatest, the surfaces of the conical piston and the interior surface of the cylinder are separated to provide the gap between the piston and the cylinder.

15. An actuator according to claim 1 wherein:

the variable volume post-expansion chamber comprises a relatively moveable piston and cylinder, the piston and cylinder having a mating conical profile so that when the volume of the post-expansion chamber is at its least, the conical piston mates against the interior surface of the cylinder to close a gap between the piston and the cylinder, and when the volume of the post-expansion chamber is at its greatest, the surfaces of the conical piston and the interior surface of the cylinder are separated to provide a gap between the piston and the cylinder, the gap comprising the suction opening, the variable volume suction chamber is provided by a resiliently flexible walled chamber the volume of which can be reduced by external pressure applied by an operator, and which returns back resiliently toward its original volume to thereby cause negative atmospheric pressure in the suction chamber, the piston being operably connected with the flexible wall of the suction chamber, the resiliently flexible wall of the suction chamber comprises an operating button operably connected to the control part, so that in use the user may exert pressure upon such an operating button to thereby reduce the volume of the suction chamber, and to simultaneously or subsequently move the control part in the first direction.

16. A dispenser for a pressurized fluid comprising a container containing the pressurised fluid and having an operable valve via which the fluid is dispensed, having the valve actuator of claim 1 mounted thereon.

* * * * *